US005604939A

United States Patent [19]

Widener

[11] Patent Number: 5,604,939

[45] Date of Patent: Feb. 25, 1997

[54] SWIMMING POOL SKIMMER CLOSURE

[76] Inventor: Robert E. Widener, 4607 Lee Hwy., Verona, Va. 24482

[21] Appl. No.: 528,349

[22] Filed: Sep. 14, 1995

[51] Int. Cl.[6] ..... E04H 4/00

[52] U.S. Cl. ..... 4/507; 4/496

[58] Field of Search ..... 4/507, 496, 504, 4/490, 293, 295; 210/169; 138/90

[56] References Cited

U.S. PATENT DOCUMENTS

| | | | |
|---|---|---|---|
| 936,312 | 10/1909 | Danford | 4/293 |
| 3,831,897 | 8/1974 | Stegmeier | 4/507 |
| 4,281,422 | 8/1981 | Simonelli | 138/90 |
| 4,903,351 | 2/1990 | Dengel et al. | 4/496 |
| 4,913,810 | 4/1990 | Hodak | 210/169 |
| 5,273,077 | 12/1993 | Oropallo | 138/90 |
| 5,285,538 | 2/1994 | Hodak | 210/169 |

*Primary Examiner*—David J. Walczak
*Attorney, Agent, or Firm*—Brady, O'Boyle & Gates

[57] ABSTRACT

A swimming pool skimmer closure having a sealing face plate positioned across the open end of the skimmer inlet and held thereon by a bolt extending through the center of the face plate and through a transversely extending brace member abutting interior, transversely spaced shoulders integral with the skimmer housing. The face plate is tightened into sealing engagement against the skimmer inlet by a nut threaded onto the end of the bolt and abutting the brace member so that the skimmer can be drained without draining the pool water during the winterization of the pool.

9 Claims, 3 Drawing Sheets

23
30
37
26a
22
35
27
29
44
45
43
40
39
25
42
28
41
26
33
38
31
32
34
24

SWIMMING POOL SKIMMER CLOSURE

BACKGROUND OF THE INVENTION

When winterizing a swimming pool, the conventional skimmer, mounted on the side of the pool and communicating with a filter and water recirculating system, has to be drained of all water to prevent damage to the filter and associated pipes and pump in the recirculation system due to freezing during the winter months.

To drain the standing water in the skimmer, it was first necessary to drain the water from the pool until the pool water reached a level below the inlet to the skimmer.

In order to conserve water, it has been proposed to provide a cover for the skimmer inlet, whereby the interior of the skimmer is sealed off from the pool water so that the skimmer can be drained without first draining water from the pool. While these covers have been satisfactory for their intended purpose, they are characterized by certain disadvantages, such as not being universally mountable on various types of skimmers, and requiring a number of bolts and screws to secure the cover on a flange surrounding the skimmer inlet.

After considerable research and experimentation, the skimmer closure of the present invention has been devised and is an improvement over heretofore employed skimmer covers in that the closure of the present invention can be mounted on a wide variety of pool skimmers without requiring the use of bolts and screws for securing the closure to the skimmer flange surrounding the inlet, which flange many skimmers do not have.

SUMMARY OF THE INVENTION

The swimming pool skimmer closure of the present invention comprises, essentially, a sealing face plate adapted to be positioned across the skimmer inlet and held in sealing relationship therewith by a bolt extending through the center of the face plate and through a transversely extending brace abutting interior, transversely spaced shoulders integral with the skimmer housing. The face plate is tightened against the skimmer inlet by a nut threaded onto the end of the bolt and abutting the brace.

DESCRIPTION OF THE PREFERRED EMBODIMENTS

Figure 1:
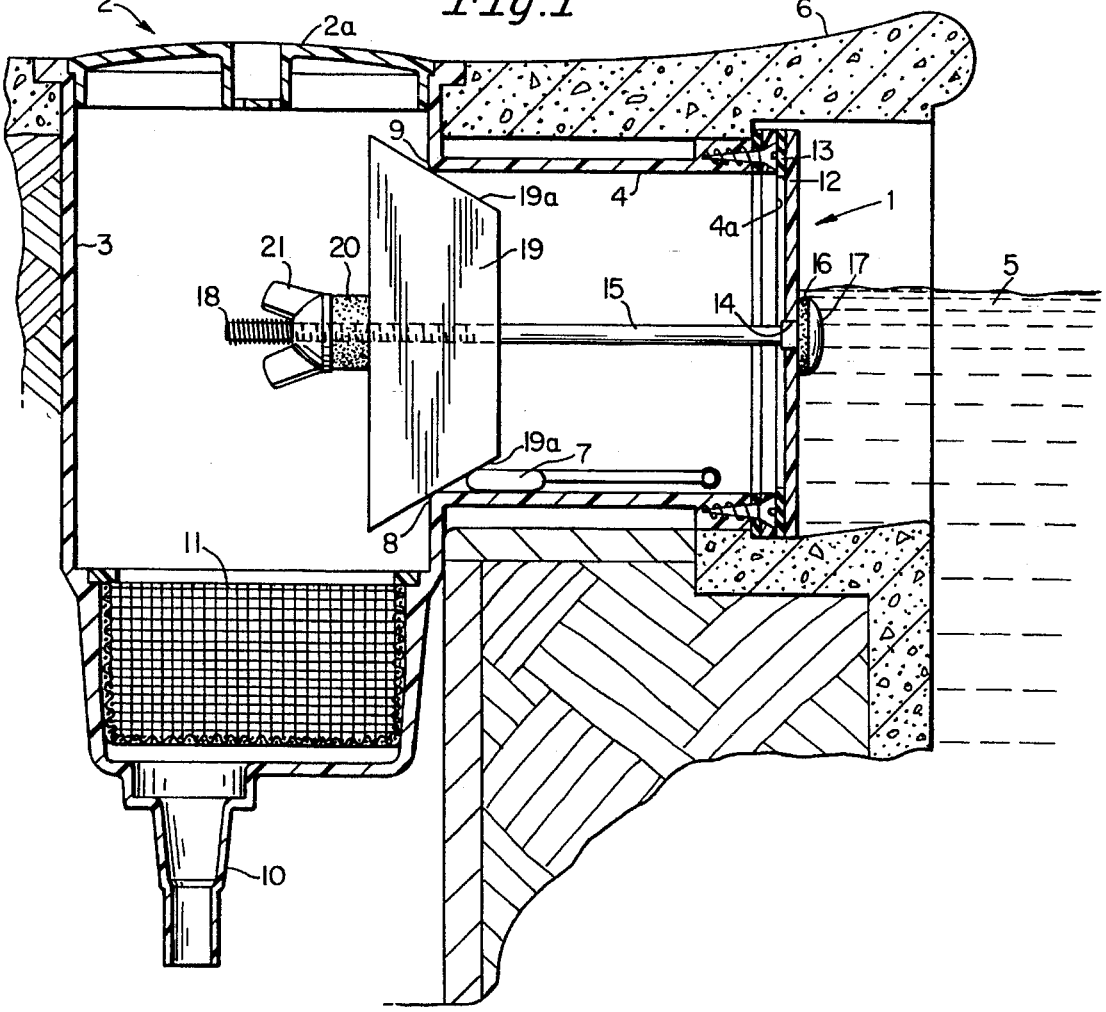
FIG. 1 is a side elevational view partly in section showing one embodiment of the closure of the present invention mounted on a type of skimmer which can be employed in an in-ground pool or an above-ground pool.
Figure 2:
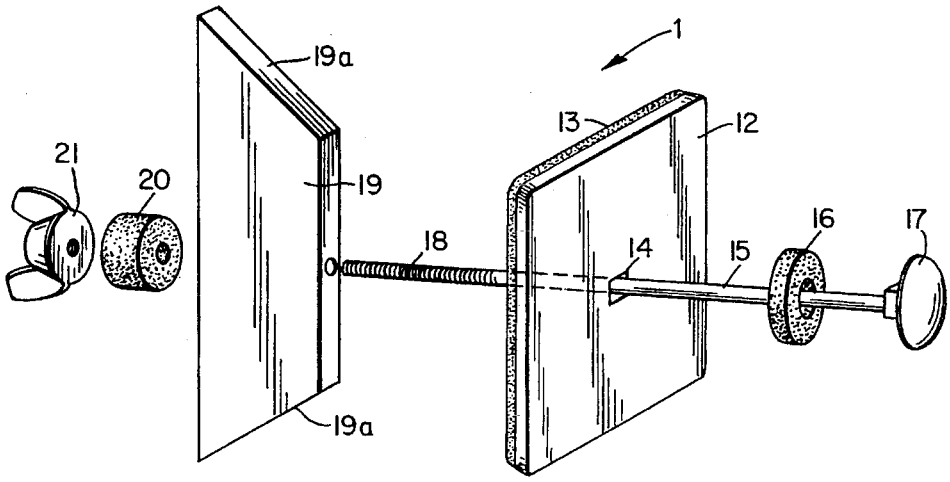
FIG. 2 is an exploded, perspective view of the closure and associated fastening components shown in FIG. 1.

Referring to the drawings and, more particularly, to FIGS. 1 and 2, the closure 1 of the present invention is adapted to be mounted on a conventional skimmer 2 including a housing 3 having an inlet portion 4 communicating through an open end 4*a* with the water 5 in a swimming pool 6. A weir plate 7 is pivotally mounted in the inlet portion 4, and a pair of interior, transversely spaced shoulders 8 and 9 are integral with the skimmer housing 3. The housing 3 also includes a fitting 10 adapted to be connected to the filter and water circulating system (not shown), a screen basket 11 for catching debris flowing through the housing 3, and a removable vent cover 12 to provide access to the debris basket 11.

The closure 1 comprises a rectangular face plate 12 having a gasket 13 extending around the periphery of the inner surface thereof. An aperture 14 is provided in the face plate 12 through which a bolt 15 extends and a sealing washer 16 is provided between the outer surface of the face plate 12 and bolt head 17. The threaded end 18 of the bolt 15 extends through a brace or wedge member 19, a resilient spacer 20, and wing nut 21.

The wedge member 19 is trapezoidal in shape wherein the tapered sides 19*a* are adapted to engage the interior, transversely spaced shoulders 8 and 9 in the housing 3.

To mount the closure 1 in the sealing position, the vent cover 2*a* is removed and the wedge member 19 is inserted into the skimmer housing 3 and positioned so that the sides 19*a* of the wedge member 19 abut the shoulders 8 and 9. The face plate 12, having the bolt 15, extending therethrough, is then held against the open end 4*a* of the inlet portion 4, and the spacer 20 and wing nut 21 are mounted on the threaded end 18 of the bolt. By tightening the wing nut 21, the sides 19*a* of the wedge member 19*a* are forced against the housing shoulders 8 and 9, so that the gasket 13 on the face plate 12 is forced into sealing engagement with the open end 4*a* of the skimmer inlet portion 4. The installation of the closure 1 can be accomplished without draining the water 5 from the pool 6 to a level below the skimmer inlet 4 so that only the skimmer 2 need be drained when winterizing the pool 6.

Figure 3:
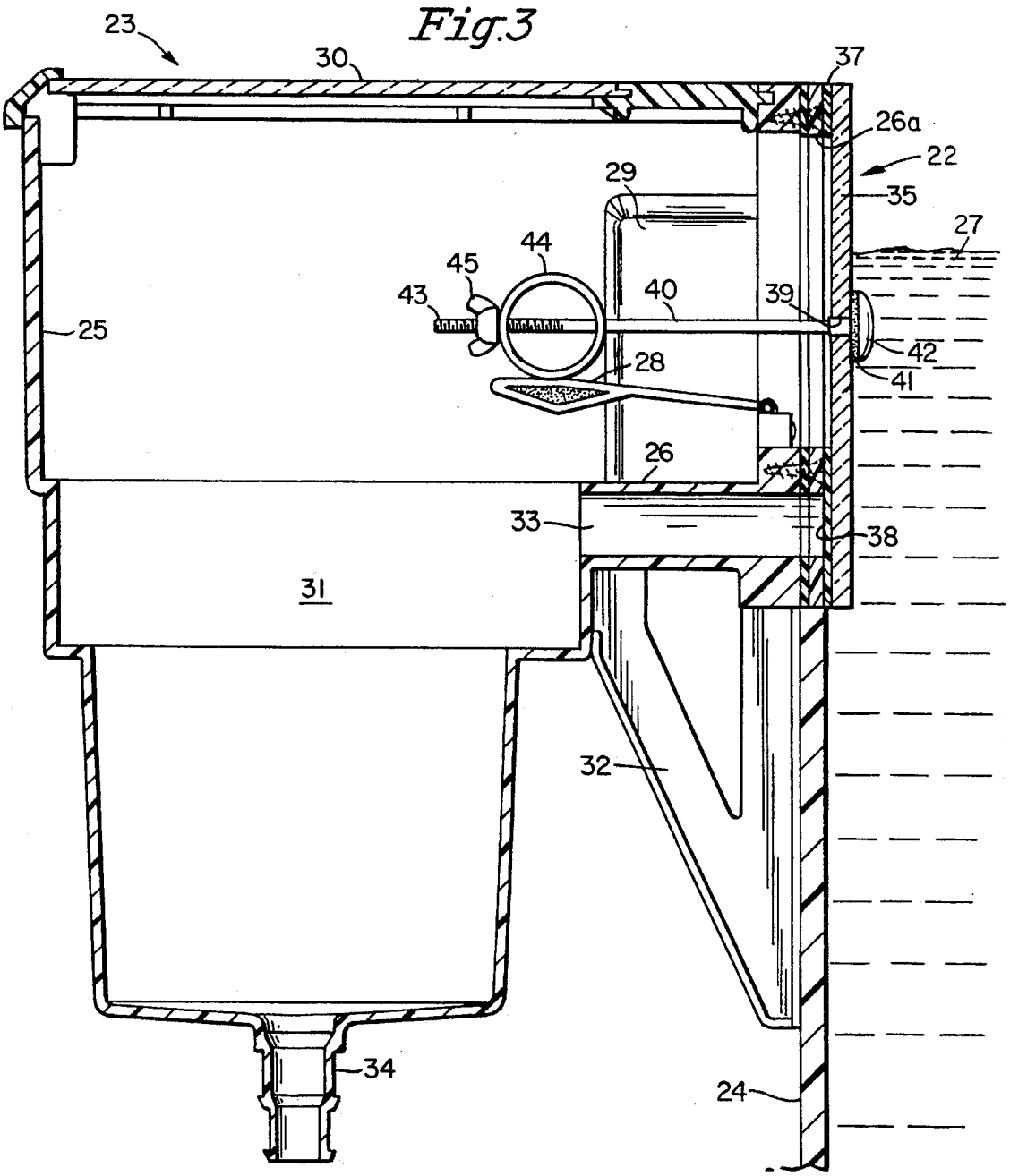
FIG. 3 is a side elevational view partly in section showing another embodiment of the closure mounted on another type of skimmer employed in an above-ground pool.
Figure 4:
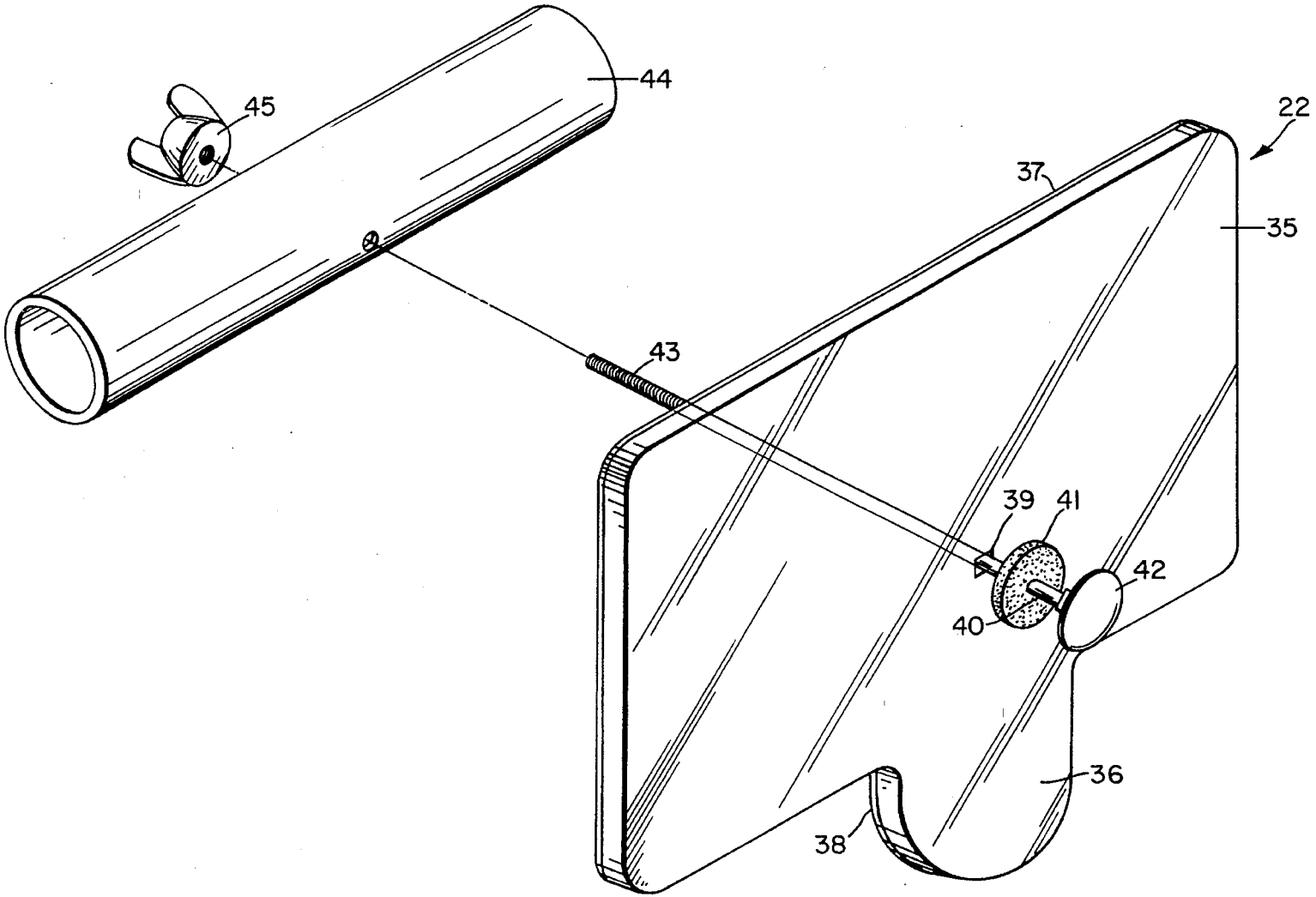
FIG. 4 is an exploded, perspective view of the closure and associated fastening components shown in FIG. 3.

While the closure 1 shown in FIGS. 1 and 2 has been described for use on a skimmer mounted on an in-ground pool, FIGS. 3 and 4 show a similar closure 22 for use on a skimmer 23 mounted on an above-ground pool 24. The skimmer 23 includes a housing 25 having an inlet portion 26 communicating through an open end 26*a* with the water 27 in the swimming pool 24. A weir plate 28 is pivotally mounted in the inlet portion 26 and a pair of interior, transversely spaced shoulders 29 are integral with, and protrude inwardly from, the opposite side walls of the skimmer housing 25. The skimmer also includes a transparent top cover 30, an area 31 for holding a debris screen basket, not shown, wall braces 32, an opening 33 to which a source of vacuum is adapted to be connected when cleaning the skimmer, and a fitting 34 adapted to be connected to the filter and water circulating system, not shown.

The closure 22 comprises a substantially rectangular face plate 35 having a depending extended portion 36 and a first gasket 37 extending around the periphery of the inner surface of the rectangular portion of the fact plate 35 and a second gasket 38 extending across the entire inner surface of the extended portion 36. An aperture 39 is provided in the face plate 35 through which a bolt 40 extends and a sealing washer 41 is provided between the outer surface of the face plate 35 and bolt head 42. The threaded end 43 of the bolt 40 extends through a transversely extending brace 44 consisting of a tubular member, such as a plastic pipe, and a wing nut 45.

To mount the closure 22 in the sealing position, the transparent cover 30 is removed and the pipe 44 is inserted into the skimmer housing 25 and positioned so that the opposite end portions of the pipe 44 abut the transversely spaced shoulders 29. The face plate 35 having the bolt 40 extending therethrough is then held against the open end 26*a* of the inlet portion 26, and the wing nut 45 is threaded onto the bolt 40. By tightening the wing nut 45, the opposite end portions of the pipe 44 are forced against the housing shoulders, so that the first gasket 37 on the face plate 35 and the second gasket 38 on the extended portion 36 are forced into sealing engagement with the open end 26*a* of the skimmer inlet 26, and the vacuum opening 33, respectively.

From the above description, it will be readily appreciated by those skilled in the art that the swimming pool skimmer closure of the present invention is an improvement over other closures constructed and arranged to close off the skimmers without draining the pool during the winterizing thereof, in that the closure of the present invention can be used on various types of skimmers by merely changing the type of braces positioned within the skimmer housing.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. In combination closure and a swimming pool skimmer having a housing including a side wall an inlet portion having an open end adapted to communicate with water in a swimming pool and an opposite end adapted to enable water from the swimming pool to flow to a filter, and a pair of interior transversely spaced shoulders integral with said sidewall and in proximity to the inlet portion and spaced inwardly from the open end of said inlet portion; said closure comprising a face plate having an inner surface and an outer surface, said inner surface abutting the open end of said inlet portion, a transversely extending brace member positioned in said inlet portion and abutting said shoulders, and means for fastening said face plate to said brace member and to said housing for holding said face plate in sealing engagement with said open end, whereby the skimmer can be drained without draining the water from the swimming pool during the winterizing of the pool.

2. The combination according to claim 1 wherein a gasket is secured to said inner surface of said face plate.

3. The combination according to claim 2, wherein the face plate is rectangular and having a peripheral edge portion and the gasket extends around the peripheral edge portion on the inner surface.

4. The combination according to claim 3, wherein the skimmer includes a vacuum opening positioned below the open end of the inlet portion, said face plate having a depending portion covering said opening, and a gasket secured to, and extending across, the entire inner surface of the depending portion.

5. The combination according to claim 1, wherein the brace member is trapezoidal in shape and having tapered side edges, said tapered side edges of the trapezoidal member engaging said shoulders in the skimmer housing.

6. The combination according to claim 1, wherein the brace member comprises a tubular member having opposite edge portions thereof engaging the shoulders in the skimmer housing.

7. The combination according to claim 1, wherein the means for fastening the face plate to said brace member and to said housing comprises a bolt having a head and a threaded end extending through the face plate and the brace member, and a nut threaded onto the bolt and abutting the brace member.

8. The combination according to claim 7, wherein a sealing washer is positioned between the bolt head and the outer surface of the face plate.

9. The combination according to claim 7, wherein a resilient spacer is positioned between the nut and the brace member.

* * * * *